US007980524B2

(12) United States Patent
Parker

(10) Patent No.: US 7,980,524 B2
(45) Date of Patent: Jul. 19, 2011

(54) SUSPENSION TRAUMA RELIEF DEVICE

(75) Inventor: Michael J. Parker, Houston, TX (US)

(73) Assignee: Willingham Systems, LLC, Houston, TX (US)

( * ) Notice: Subject to any disclaimer, the term of this patent is extended or adjusted under 35 U.S.C. 154(b) by 0 days.

(21) Appl. No.: 10/860,949

(22) Filed: Jun. 4, 2004

(65) Prior Publication Data

US 2005/0269475 A1 Dec. 8, 2005

(51) Int. Cl.
*A62B 1/00* (2006.01)

(52) U.S. Cl. ..... 248/317; 182/3; 182/6

(58) Field of Classification Search ..... 248/317; 182/3, 6, 9, 36

See application file for complete search history.

(56) References Cited

U.S. PATENT DOCUMENTS

| | | | | | |
|---|---|---|---|---|---|
| 119,997 | A | * | 10/1871 | Rice | 188/65.5 |
| 428,812 | A | * | 5/1890 | Johanson | 182/135 |
| 1,169,760 | A | * | 2/1916 | Barrett | 182/6 |
| 1,212,301 | A | * | 1/1917 | Wick | 182/6 |
| 1,767,554 | A | * | 6/1930 | Rose | 182/4 |
| 2,078,146 | A | * | 4/1937 | Le Blanc | 182/76 |
| 2,810,504 | A | * | 10/1957 | Pula | 182/134 |
| 3,717,219 | A | * | 2/1973 | Hoffman | 182/6 |
| 3,814,210 | A | * | 6/1974 | Hoffman | 182/6 |
| 3,869,021 | A | * | 3/1975 | Sutherland et al. | 182/3 |
| 4,515,240 | A | * | 5/1985 | Curtis | 182/6 |
| 4,667,772 | A | * | 5/1987 | Kammerer | 182/6 |
| 5,878,833 | A | * | 3/1999 | Bell | 182/3 |
| 6,467,851 | B1 | | 10/2002 | Mannell et al. | 297/484 |
| 6,739,427 | B2 | | 5/2004 | Gayetty | 182/3 |

OTHER PUBLICATIONS http://www.clamcleat-rope-cleats.com; "*Cleats for 2-6 mm, 1/16"-1/4" Rope*" (7 p.).
www.webdevices-usa.com; "*Web Devices, Harnessing the Future*" (5 p.).
www.bacou-dalloz.com; "*Relief Step Safety Device*" (1 p.).
[online]: Retrieved from the Internet on Jun. 17, 2004: <URL: http://www.osha.gov/dts/shib/shib032404.html.

* cited by examiner

*Primary Examiner* — Terrell McKinnon
*Assistant Examiner* — Steven M Marsh
(74) *Attorney, Agent, or Firm* — Conley Rose, P.C.

(57) ABSTRACT

A suspension trauma relief device includes a member extending from a ring to which the safety harness and lanyard are attached. The member provides a support for the wearer so that the wearer can take his/her weight off of the safety harness, and particularly the leg straps on the safety harness, to allow blood circulation and prevent suspension trauma. Preferably the member includes at least one foot support allowing at least one of the wearer's feet to be placed in the foot support to take the wearer's weight off the safety harness and avoid any constriction of the straps of the safety harness on the person's blood flow.

15 Claims, 6 Drawing Sheets

SUSPENSION TRAUMA RELIEF DEVICE

BACKGROUND OF THE INVENTION

Much attention has been directed towards improving the safety of persons who work at high elevations by providing them with protective devices, such as safety harnesses and lanyards, to suspend them in the event of an accidental fall. However, little emphasis has been placed on how to minimize potential injuries to a person who has fallen and is suspended in a safety harness. One of the most serious risks of injury or death to such a person is created by a condition known as "suspension trauma." Suspension trauma is a subset of phenomenon known as "orthostatic intolerance" which is caused by a reduction in the circulation of blood throughout the body. More information on this condition is provided by the Occupational Health and Safety Administration's Safety Health and Information Bulletin SHIB 03-24-2004, incorporated herein by reference.

A typical safety harness 100 is shown in FIG. 2. The harness 100 includes a pair of shoulder straps 104 crossing over the shoulders and chest of the wearer and a pair of leg straps 106 extending between and around the legs of the wearer. The shoulder straps 104 and leg straps 106 are attached, such as by side buckles and buckle connectors, to a waist strap 108. The waist strap 108 is connected to a vertical support strap 110. The support strap 110 typically is affixed to a rear dorsal, attachment "D"-ring 112 at its upper end. A safety line or lanyard 102 is connected to the attachment "D'-ring 112 to support the user in the event of a fall. Examples of a safety harness are shown in U.S. Pat. Nos. 6,467,851 and 6,739,427.

The lanyard 102 connects a user's safety harness to an anchor point. The typical lanyard incorporates a shock absorbing device, which reduces the arresting forces during a fall. The shock absorber actually tears and elongates to absorb the force. This can cause the lanyard to lengthen, such as from six feet to almost nine and one-half feet, depending on the weight of the user and the distance of the fall. The user could be hanging as much as nine and one-half feet below the anchor point.

Normally anytime a user has fallen and deployed the shock absorber, rescue becomes difficult. This results in the user being subjected to a physically unsafe condition while the rescue is being carried out. Rescuers often time have trouble reaching the victim; meanwhile the victim is in great peril.

Because a person suspended in a safety harness and lanyard is in a sedentary position, blood can accumulate in the veins, which is commonly called "venous pooling." This can reduce the circulation of blood and the amount of oxygen provided to the brain and other vital organs. Venous pooling typically occurs in the legs due to the leg straps 106 and the force of gravity caused by the weight of the person suspended in the leg straps 106. Also there is a lack of movement by the person during suspension. In the veins, blood normally is moved back to the heart through one-way valves using the normal muscular action associated with limb movement. If the legs are immobile, then these "muscle pumps" do not operate effectively, and blood can accumulate. Since veins can expand, a large volume of blood may accumulate in the veins.

The leg straps 106 act like tourniquets cutting off circulation in the legs causing an accumulation of blood in the legs thereby reducing the amount of blood in circulation. The body reacts to this reduction by speeding up the heart rate in an attempt to maintain sufficient blood flow to the brain. If the blood supply is significantly reduced, this reaction will not be effective. The body will abruptly slow the heart rate and blood pressure will diminish in the arteries. During severe venous pooling, the reduction in blood and oxygen flowing to the brain causes fainting. This reduction also can have an effect on other vital organs, such as the kidneys. The kidneys are very sensitive to blood oxygen, and renal failure can occur with excessive venous pooling. If these conditions continue, they potentially may be fatal.

Orthostatic intolerance may occur in many different situations where a person remains stationary for an extended period of time with the heart above the legs. One well-known example of orthostatic intolerance is that of a person who faints while standing for a long period of time with his or her "knees locked" (which reduces muscle usage, and therefore, blood circulation). In that case, the moment the person loses consciousness; he or she collapses into a horizontal position. With the legs, heart, and brain on the same level, blood is returned to the heart and blood and oxygen are returned to the brain and other vital organs. Assuming no injuries are caused during the collapse, the individual will quickly regain consciousness and recovery is likely to be rapid.

Persons using fall arrest systems may also experience orthostatic intolerance or suspension trauma. After a fall, a person may remain suspended in a harness for an extended period of time. Depending on the length of time the person is suspended and the level of venous pooling, the resulting orthostatic intolerance may lead to serious injury or even death. Orthostatic intolerance presents a greater threat of injury or death to a person suspended in a safety harness than to a person who faints while standing. The risk is increased because workers suspended in a safety harness will not fall into a horizontal position if they faint, as they would if they fainted while standing. Therefore, there is no "self-correction" mechanism for a worker suspended in a harness, as there is for a person who faints while standing.

Venous pooling and orthostatic intolerance can also be exacerbated by other circumstances related to the fall. For example, shock or the experience of the event that caused the fall, other injuries, the fit or positioning of the harness, the environmental conditions, and the worker's psychological state, all may increase the onset and severity of the pooling and suspension trauma. While a person suspended in a safety harness and lanyard can reduce the effects of suspension trauma by moving his or her legs, this can quickly become difficult or impossible depending on the physical condition of the person. If measures are not taken to reduce the effects of suspension trauma, the brain, kidneys, and other organs are deprived of oxygen and serious or fatal injury may occur.

A need therefore exists to reduce the effects of suspension trauma due to suspension in a safety harness and lanyard due to a fall and reduce the likelihood of serious or fatal injury to the user.

SUMMARY OF INVENTION

The suspension trauma relief device includes a member extending from the attachment "D"-ring of the safety harness to which the lanyard is attached. The member provides a support for the wearer so that the wearer can take his/her weight off of the safety harness, and particularly the legs straps on the safety harness, to allow blood circulation and prevent suspension trauma. Preferably the member includes at least one foot support allowing at least one of the wearer's feet to be placed in the foot support to take the wearer's weight off the safety harness and avoid any constriction of the safety harness on the person's blood flow.

Various embodiments of an apparatus and method of the present invention are described for reducing the effects of suspension trauma. Embodiments of the present invention provide a support member where a person who is suspended by a device such as a safety harness may take his weight off the harness by placing his/her feet in the support member. In another preferred embodiment of the apparatus for reducing the effect of suspension trauma, the apparatus includes a member attached to the "D"-ring of the safety harness. The member includes first and second support members disposed on the member wherein the wearer's feet may be placed on the first and second support members to reduce any constriction of the safety device on the person's blood flow.

In operation the person places his/her feet in the support members and then exert a force on the support members to take the person's weight off the straps of the safety harness. This reduces the constriction on blood flow particularly at the leg straps and allows more blood flow to reduce the effects of suspension trauma. Increasing the blood flow due to muscle movement reduces the effects of suspension trauma. The effects of suspension trauma are also reduced by decreasing the constrictive effect of the safety harness on the blood vessels as a result of the relief caused by the additional support for the person provided by the support member(s). Further the wearer can now flex and move his/her leg muscles to assist in the pumping of blood through the wearer's body.

Other objects and advantages of the invention will appear from the following description.

BRIEF DESCRIPTION OF DRAWINGS

For a detailed description of the preferred embodiments of the invention, reference will now be made to the accompanying drawings wherein.

DETAILED DESCRIPTION OF THE PREFERRED EMBODIMENTS

The suspension trauma relief device includes a member extending from the safety harness "D"-ring to which the lanyard is attached. The relief device may be attached to the lanyard hook. The member provides a support for the wearer so that the wearer can take his/her weight off of the safety harness, and particularly the legs straps on the safety harness, to allow blood circulation and prevent suspension trauma. Preferably the member includes at least one foot support allowing at least one of the wearer's feet to be placed in the foot support to take the wearer's weight off the safety harness and avoid any constriction of the safety harness on the person's blood flow.

Figure 1:
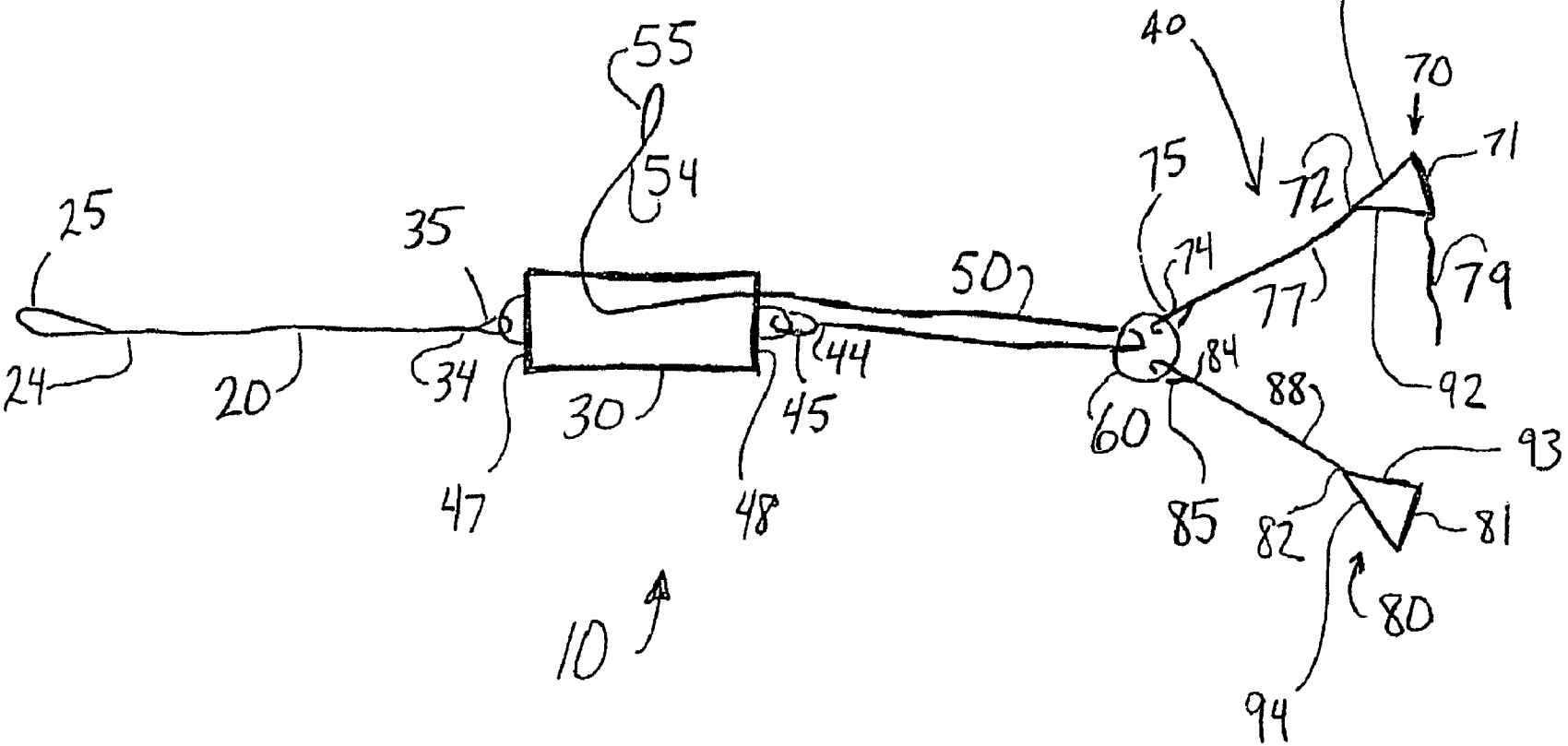
FIG. 1 is a schematic drawing of a preferred embodiment of a suspension trauma relief device.
Figure 2:
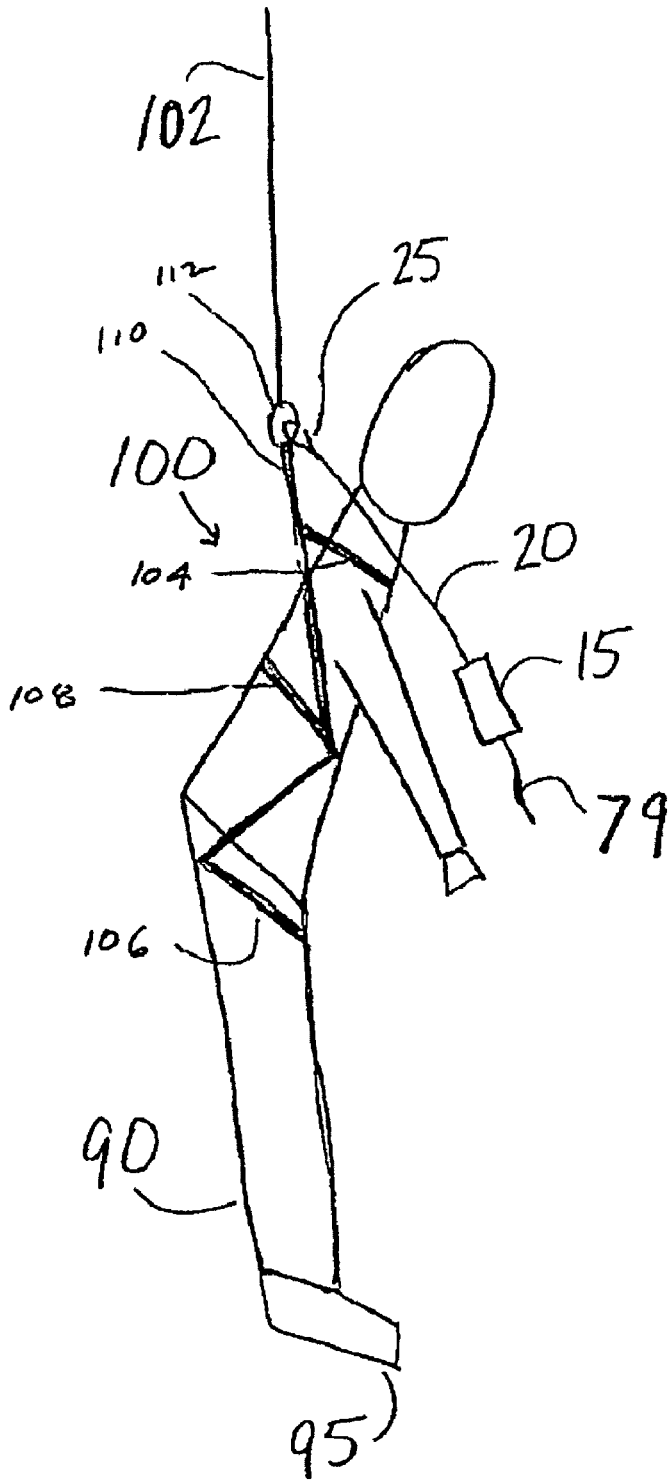
FIG. 2 is a schematic drawing of a person with a suspension trauma relief device in its container.
Figure 3:
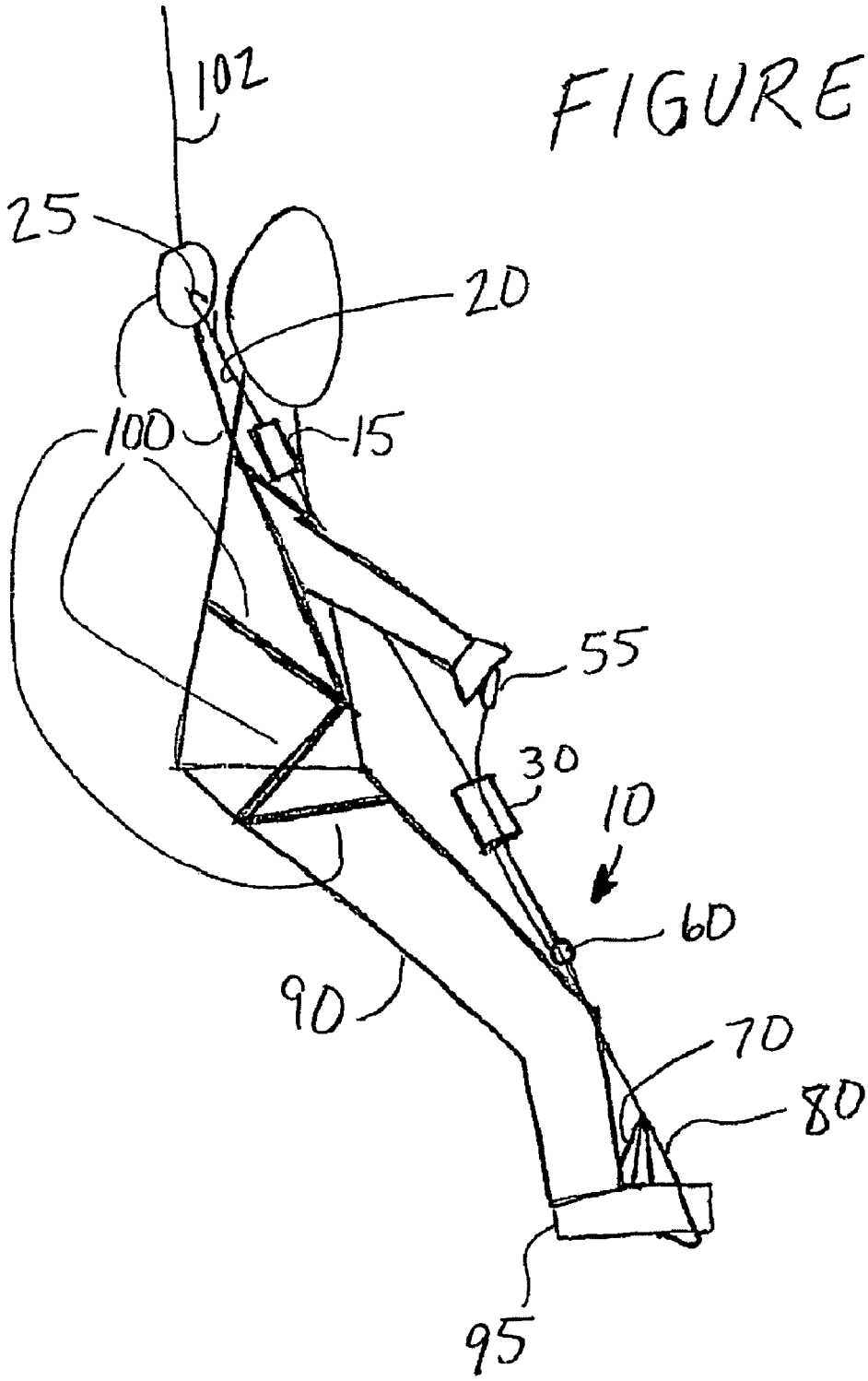
FIG. 3 is a schematic drawing of a person with a suspension trauma relief device in operation.

Referring initially to FIGS. 1-3, one preferred embodiment of the suspension trauma relief device 10 comprises an attachment member or strap 20 and a support assembly 40, both connected to an adjustment member 30. Strap 20 comprises a first end 24 with a connection member or loop 25 that can be used to attach suspension trauma relief device 10 to an external safety device capable of suspending a person. Examples of external suspension devices include lanyard 102 or one of the non-leg straps of safety harness 100 (such as vertical support strap 110), as shown in FIGS. 2 and 3. Strap 20 also comprises a second end 34 with a loop 35 or other connector that attaches strap 20 to the adjustment member 30.

Adjustment member 30 includes an adjustable length strap 50, which includes a first end 44 with a loop 45 or other connector that attaches strap 50 to adjustment member 30 and a second end 54 passing through a ring 60 and attached to adjustment member 30. The terminal end of second end 54 preferably forms a loop 55 serving as a handle.

In a preferred embodiment, adjustment member 30 is a wedge device, such as Clamcleat® Model #CL211 MK1, which allows the length of strap 50 between adjustment member 30 and ring 60 to be easily adjusted and secured. It should be appreciated that other types of adjustment devices may be used as for example buckles and fasteners.

Figure 1A:
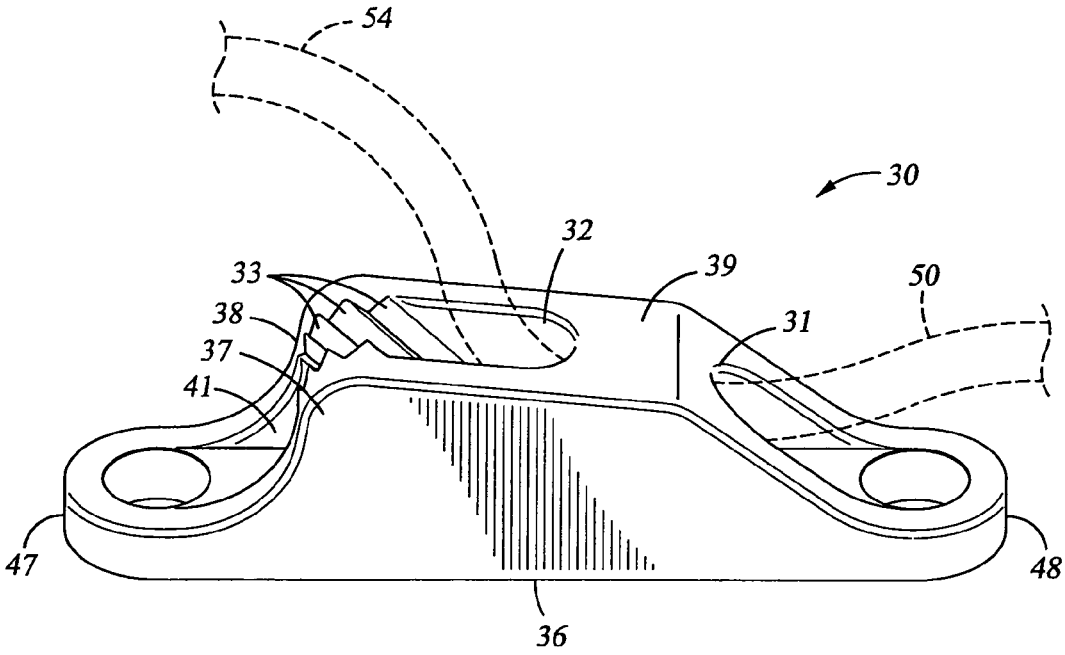
FIG. 1A is a perspective view of an adjustment member.
Figure 1B:
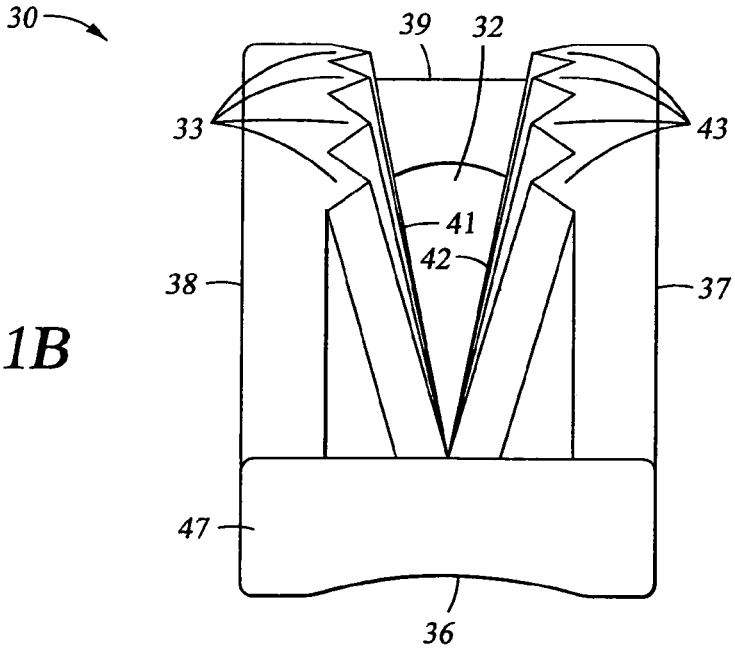
FIG. 1B is an end view of an adjustment member.

Details of a preferred embodiment of adjustment member 30 are shown in FIG. 1A and FIG. 1B. FIG. 1A is a perspective view of adjustment member 30 and FIG. 1B is an end view of adjustment member 30. Adjustment member 30 includes a base member 36 with first and second ends 47, 48 and first and second vertical members 37, 38 connected by a support member 39. Below support member 39 is a first opening 31 and above support member 39 is a second opening 32. Vertical member 38 includes an inner surface 41 with first ridges 33. As shown in FIG. 1B, vertical member 37 also includes an inner surface 42 with second ridges 43. Inner surfaces 41 and 42 form a "V" shape, also visible in FIG. 1B, to form a gripping wedge for gripping strap 50.

Strap 50 is shown in FIG. 1A to illustrate the interrelation of strap 50 to adjustment member 30. Strap 50 is shown in dashed lines for clarity in illustration, so that the details of adjustment member 30 are visible behind strap 30. As shown in FIG. 1A, strap 50 passes through first opening 31 and under support member 39. Strap 50 then passes through second opening 32 and exits adjustment member 30. When end 54 of strap 50 is pulled towards first end 47, first and second ridges 33 and 43 grab strap 50 and secure strap 50 in place. In addition, the "V" shape formed by inner surfaces 41 and 42 help to further secure strap 50. If a tensile force is applied on strap 50 from the direction of end 48, strap 50 is secured in adjustment member 30 by first and second ridges 33 and 43 and the "V" shape formed by inner surfaces 41 and 42. If end 54 of strap 50 is pulled in a direction away from base 36, strap 50 will be released from first and second ridges 33 and 43. After being released from first and second ridges 33 and 43, strap 50 may be repositioned within adjustment member 30 by pulling strap 50 in a direction towards end 48.

As shown in FIG. 1, the length of suspension trauma relief device 10 is preferably adjustable. Adjustment member 30 allows such adjustment by pulling loop 55 towards strap 20, thereby shortening the length of strap 50 by pulling strap 50 through adjustment member 30. This reduces the length of strap 50 between adjustment member 30 and ring 60. Strap 50 can be secured and released in the manner described in the discussion of FIGS. 1A and 1B. Loop 55 or another attachment such as a handle (not shown) on end 54 of strap 50 prevents end 54 from passing through adjustment member 30.

In a preferred embodiment, the support assembly 40 comprises a first strap 77 having first and second ends 72, 74 with second end 74 having a loop 75. Support assembly 40 also comprises a second strap 88 having first and second ends 82, 84 with second end 84 having a loop 85. A first support member or stirrup 70 is attached to first strap 77 at a first end 72 and a second support member or stirrup 80 is attached to second strap 88 at a first end 82. In a preferred embodiment, first stirrup 70 includes a transverse member 71 between first and second brace members 91 and 92. Similarly, second stirrup 80 includes transverse member 81 between brace members 93 and 94. In a preferred embodiment, transverse member 71 includes a material that is rigid enough to keep brace member 91 spaced a sufficient distance from brace member 92 so that a person may easily insert his or her foot into first stirrup 70. Similarly, in a preferred embodiment, transverse member 81 includes a material of similar rigidity. In a more preferred embodiment, transverse members 71, 81 are rods or shafts made of a pliable plastic such as a nylon string (not shown), such as that used in a lawn trimmer. The rods or shafts are then enclosed in a fabric covering. It should be appreciated that the transverse members 71, 81 may be stiff, solid supports, which can support the wearer's weight without bending. It should also be appreciated that transverse members 71, 81 may have a width and length sufficient to provide a surface area of support, which is comfortable to the user.

Loop 75 or other connector on second end 74 connects strap 77 to ring 60, and loop 85 or other connector on second end 84 connects strap 88 to ring 60. A release strap 79 may be attached to one of the first and second stirrups 70, 80 serving a means for removing suspension trauma relief device 10 from its storage container 15, shown in FIG. 2. In a preferred embodiment, storage container 15 is a pouch or bag with elastic disposed around openings in each end.

Straps 20, 50, 77, 79, and 88 are preferably made of nylon webbing that is ⅝ of an inch wide. However, other embodiments may comprise straps of different sizes, or alternate materials, such as cord, rope or wire.

Referring now to FIG. 2, a person 90 is shown suspended by a safety harness 100 and lanyard 102. Suspension trauma relief device 10 is contained within storage container 15. Strap 20 protrudes from the top of storage container 15 and attaches suspension trauma relief device 10 to "D"-ring 112 of safety harness 100 and lanyard 102 by a loop 25 or other connection member (not shown). Strap 79 protrudes from storage container 15, allowing person 90 to pull on strap 79 and easily remove suspension trauma relief device 10 from storage container 15.

Referring now to FIG. 3, a suspension trauma relief device 10 is shown in operation. Person 90 is suspended from lanyard 102 by safety harness 100. Person 90 has removed suspension trauma relief device 10 from storage container 15 and adjusted the length of suspension trauma relief device 10 by pulling loop 55 towards strap 20. By pulling loop 55 in this direction, the distance between adjustment member 30 and ring 60 is reduced. This raises stirrups 70 and 80 to a height where person 90 can place his or her feet 95 in stirrups 70 and 80. Alternatively, strap 50 may be released by pulling on loop 55 in a direction perpendicular to the direction used to adjust the length of suspension trauma relief device 10 and away from person 90. By releasing strap 50 in this manner, the length of suspension trauma relief device 10 may be increased or decreased if necessary. Strap 50 may then be re-secured by pulling loop 55 towards strap 20. With strap 50 secured, person 90 can then use suspension trauma relief device 10 to support a portion of his or her body weight by standing or partially standing on stirrups 70 and 80 and exerting a force on stirrups 70 and 80 with his or her feet 95. Adjustment member 30 secures strap 50 when a force is applied on strap 50 in a direction towards stirrups 70 and 80. If desired, suspension trauma relief device 10 can be designed to support the full body weight of person 90, so that safety harness 100 does not support the weight of person 90 after he or she exerts a sufficient force on stirrups 70 and 80. It is therefore preferable that connection member or loop 25 attach suspension trauma relief device 10 directly to the "D"-ring and lanyard connection 112 as shown in FIG. 3 or near the top of safety harness 100, such as to the vertical support strap 110. With the connection directly to the "D"-ring 112 or near the top 110 of safety harness 100, the suspension trauma relief device 10 can effectively bypass safety harness 100 and particularly the leg straps 106 and allow person 90 to support his or her body weight with leg muscles. This reduces the constrictive effect of safety harness 100 and increase blood circulation throughout the body.

Figure 4:
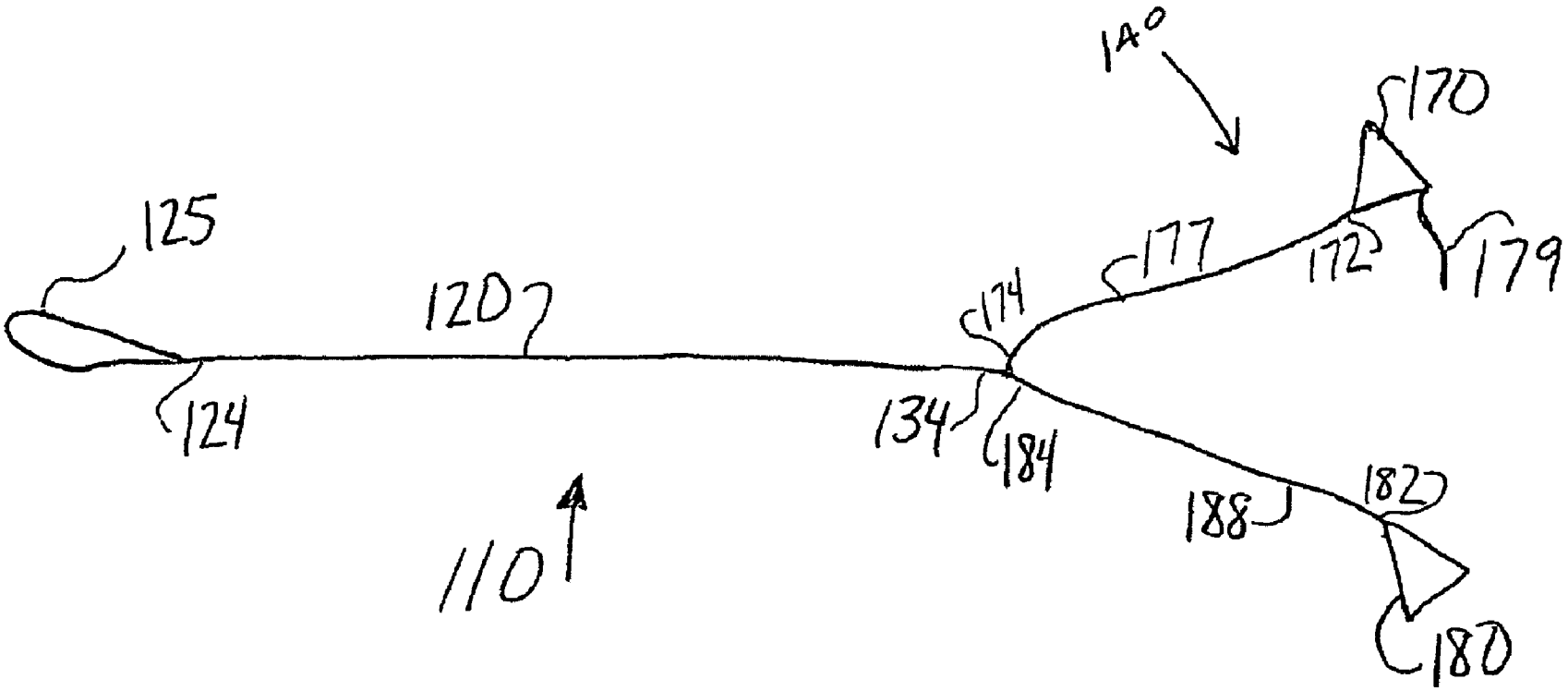
FIG. 4 is a schematic drawing of another preferred embodiment of a suspension trauma relief device.

Referring now to FIG. 4, a second preferred embodiment of suspension trauma relief device 110 is shown. In this embodiment, device 110 is non-adjustable and there is no adjustment member to adjust the length of suspension trauma relief device 110. It is therefore contemplated that the length of suspension trauma relief device 110 would be appropriately sized for an individual person's height. For example, suspension trauma relief device 110 could be produced in a specific length and labeled with a corresponding range of heights of persons who may correctly use that length. Other lengths of suspension trauma relief device 110 could be produced for persons of different heights. In this embodiment, the length of suspension trauma relief device 110 would not have to be exactly matched to a person's height, but must not be so long that a person cannot use the stirrups 170 and 180 to support a portion of the person's body weight.

In this embodiment, suspension trauma relief device 110 comprises an attachment member or strap 120 with a first end 124 having a loop 125 that can be used to attach suspension trauma relief device 110 to an external suspension device. Strap 120 further comprises a second end 134, attached to a support assembly 140 with first and second straps 177 and 188. Strap 177 has first and second ends 172, 174, and strap 188 has first and second ends 182, 184. End 174 of strap 177 and end 184 of strap 188 are attached to end 134 of strap 120 such as by a ring or by sewing the straps together. Suspension trauma relief device 110 further comprises first support member or stirrup 170, which is attached to end 172 of strap 177, and second support member or stirrup 180, which is attached to end 182 of strap 188. A strap 179 may be attached to first stirrup 170 as a means of removing suspension trauma relief device 110 from its storage container. Straps 120, 150, 177, 179, and 188 are preferably made of nylon webbing that is ⅝ of an inch wide. However, other embodiments may comprise straps of different sizes, or alternate materials, such as cord, rope or wire.

With the exception of the adjustment member, this embodiment of the invention operates in the same manner as the previously described embodiment. For example, a person suspended in a safety harness may remove suspension trauma relief device 110 from a storage container by pulling on strap 179. Suspension trauma relief device 110 then hangs in front of the person with stirrups 170 and 180 at a height near the person's feet. Because suspension trauma relief device 110 has been sized for the person's height prior to use, there is no need to adjust the length of suspension trauma relief device 110 to place stirrups 170 and 180 in their proper position. Once suspension trauma relief device 110 has been removed from its storage container, the person can place his/her feet in stirrups 170 and 180 and exert a force against stirrups 170 and 180. By doing so, a portion of the person's body weight is supported by suspension trauma relief device 110. By moving the leg muscles, blood is pumped through the body.

Figure 5:
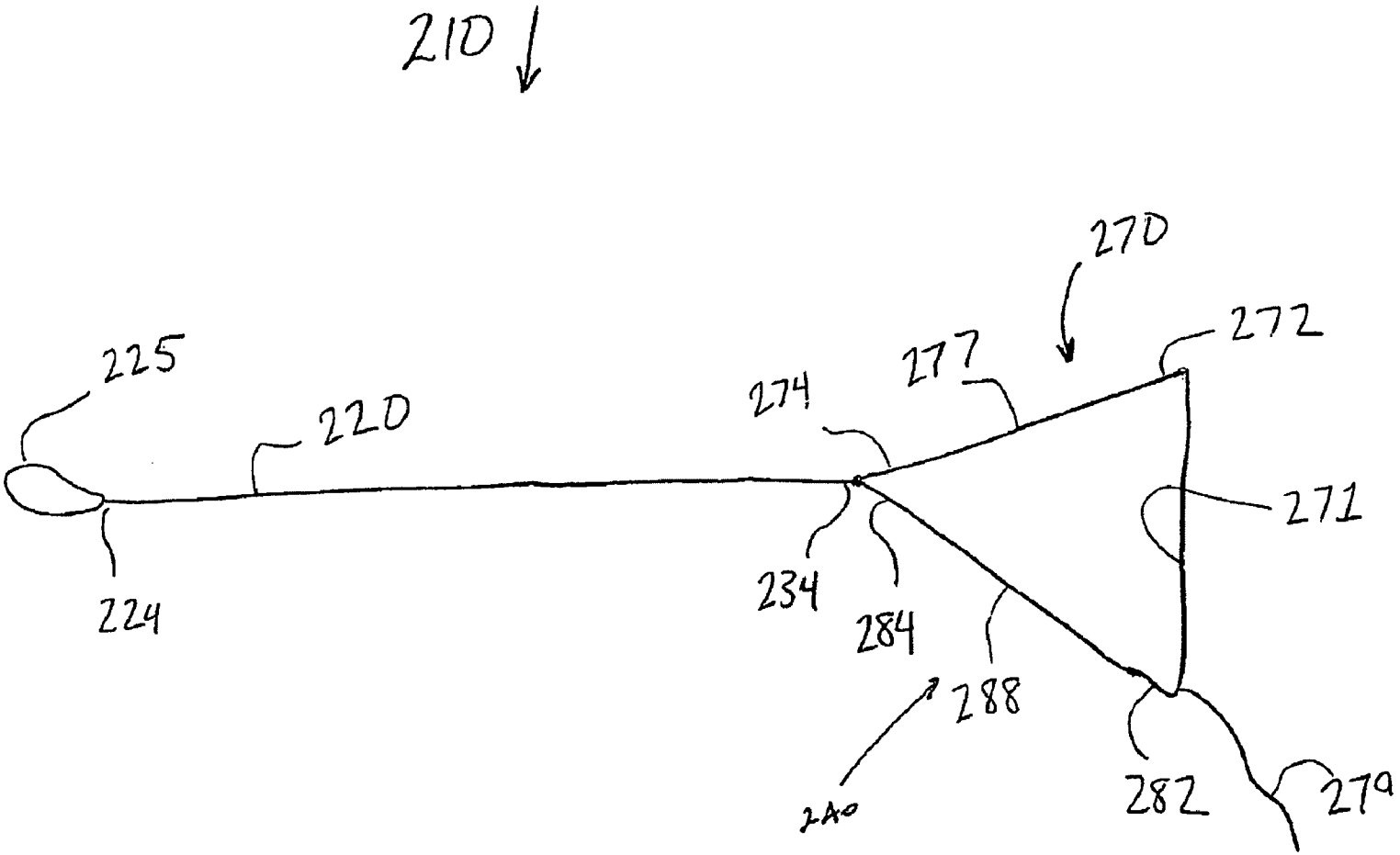
FIG. 5 is a schematic drawing of still another preferred embodiment of a suspension trauma relief device.

Referring now to FIG. 5, yet another preferred embodiment of the invention is shown. In this embodiment, the support assembly 240 includes only one support member or stirrup, instead of individual stirrups for each of the user's feet. In the embodiment of FIG. 5, a suspension trauma relief device 210 comprises an attachment member or strap 220 with a first end 224 having a loop 225 that can be used to attach suspension trauma relief device 210 to an external suspension device. It should be appreciate that any type of fastener may be used. Strap 220 further comprises a second end 234, attached to support member or a stirrup 270. Stirrup 270 has a large enough length so that a person may place one or both feet in stirrup 270. Stirrup 270 includes a first brace member 277 with a first end 274 and a second brace member 288 with a first end 284. First ends 274 and 284 are attached to end 234 of strap 220. In addition, brace member 277 includes a second end 272 and brace member 288 includes a second end 282. Second ends 272 and 282 are attached to opposite ends of transverse member 271. Transverse member 271 may be a rigid member, which can support the wearer's weight without bending. Still further, transverse member 271 may have an upwardly facing rectangular surface so as to provide a surface area, which is comfortable to the feet. By being a rigid member, transverse member 271 does not permit brace members 277, 288 to collapse around the wearer's feet so as to pinch the feet and cut off circulation. A strap 279 may be attached to stirrup 270 as a means of removing suspension trauma relief device 210 from a container.

The embodiment shown in FIG. 5 operates in the same manner as the embodiment of FIG. 4, with the exception that a person places one or both of his/her feet in single stirrup 270, instead of in individual stirrups. It should be appreciated that the embodiment of FIG. 5 may be used with an adjustment member 30 as shown in FIG. 1.

By allowing a person to support his/her weight with the suspension trauma relief device, the negative effects of suspension trauma can be minimized. Exerting a force on the stirrups with his/her feet requires a person to use leg muscles, which results in increased blood circulation. In addition, supporting a person's weight with the suspension trauma relief device also reduces the support needed by a safety harness. Supporting a person's body weight with a safety harness can have a negative impact on blood circulation, due to the constrictive effect of the straps. This is especially true of the straps around a person's lower body or legs, which support the majority of the person's weight after a fall. The harness straps must be tight enough to secure a person in the event of a fall, and become even more constrictive if the person's full body weight is supported by them after a fall. This constrictive effect, coupled with a lack of muscle use and the force of gravity, contribute to increase the likelihood of suspension trauma. However, by allowing a person to support his or her weight with the suspension trauma relief device, the constrictive effects of the safety harness straps are greatly reduced. This, in combination with the use of leg muscles to support the person's weight, will increase blood circulation and reduce the effects of suspension trauma.

The suspension trauma relief device should be attached to the person's safety harness or other suspension device as part of the personal protective equipment routinely used by persons working at elevated heights. While the suspension trauma relief device is simple to operate, a sufficient level of training will be required to teach a person how to properly use the device. With proper use, the suspension trauma relief device will allow a person who has fallen to minimize the effects of suspension trauma while waiting on rescue personnel to safely retrieve the fallen person. Rescue personnel should also be trained on how to reduce the effects of suspension trauma during (and after) rescue operations.

While preferred embodiments of the present invention have been shown and described, modifications thereof can be made by one skilled in the art without departing from the spirit or teachings of this invention. The embodiments described herein are exemplary only and are not limiting. The particular features of the embodiments described above are exemplary of the invention and may be useful with different embodiments not necessarily having all of the same features. For example, loops 25, 35, 45, 75, and 85 in FIG. 1 may be replaced with other connection or attachment mechanisms or devices, including clasps, hooks, or carabiners. Use of the terms "connect" or "attach" (and variations thereof) in the specification and claims includes both direct and indirect means of connection or attachment. Furthermore, adjustment member 30 in FIG. 1 may be any device capable of adjusting and securing a support member.

Similar modifications may be performed to the embodiments shown in FIGS. 4 and 5 without departing from the spirit or teachings of this invention. Many variations and modifications are possible and are within the scope of the invention. Accordingly, the scope of protection is not limited to the embodiments described herein.

What is claimed is:

1. An apparatus for reducing the effect of suspension trauma to a person suspended in a safety device attached to an anchor point, the apparatus comprising:

an attachment member configured for attachment to the anchor point;

a support assembly disposed on said attachment member wherein the support assembly is configured to allow at least one of the person's feet to be placed on said support assembly to reduce any constriction of the safety device on the person's blood flow;

an adjustment member between said attachment member and said support assembly; and a strap attached to the adjustment member and the support assembly, wherein said strap can be moved relative to said adjustment member to adjust a distance between said adjustment member and said support assembly and then said strap can be transversely gripped by opposed ridged surfaces on said adjustment member to fix the distance between said adjustment member and said support assembly to allow the person to place weight on said support assembly and reduce the person's weight on the safety device.

2. An apparatus for reducing the effect of suspension trauma to a person suspended by a safety device, the apparatus comprising:

an attachment member configured for attachment to the safety device;

a support assembly disposed on said attachment member wherein the support assembly is configured to allow at least one of the person's feet to be placed on said support assembly to reduce any constriction of the safety device on the person's blood flow;

an adjustment member between said attachment member and said support assembly;

a strap attached to the adjustment member and the support assembly, wherein said strap can be moved relative to said adjustment member such that a distance between said adjustment member and said support assembly can be adjusted; and wherein the adjustment member comprises a wedge configured to transversely grip said strap.

3. The apparatus of claim 1, wherein:

said support assembly includes first and second support members connected to said adjustment member, wherein the person may place a first foot on said first support member and a second foot on said second support member.

4. The apparatus of claim 1, wherein:

said support assembly supports a portion of said person's body weight when said person exerts a force against said support assembly with said person's feet.

5. The apparatus of claim 4, wherein a force applied on the person by the safety device is reduced after the person exerts a force against said support assembly.

6. The apparatus of claim 1, wherein said apparatus is configured to attach to the safety device at a point near a top of the safety device.

7. The apparatus of claim 1, wherein said apparatus is configured to hang below the safety device.

8. The apparatus of claim 1, wherein said support assembly includes stirrups.

9. The apparatus of claim 1, wherein said adjustment member comprises a wedge configured to grip said strap.

10. The apparatus of claim 9, wherein said wedge is a one-piece wedge configured to grip said strap.

11. The apparatus of claim 2, wherein said support assembly includes first and second support members connected to said adjustment member, wherein the person may place a first foot on said first support member and a second foot on said second support member.

12. The apparatus of claim 2, wherein said support assembly includes stirrups.

13. The apparatus of claim 2, wherein said adjustment member comprises a one-piece wedge configured to grip said strap.

14. An apparatus for reducing the effect of suspension trauma to a person suspended by a safety harness, the safety harness attached to a person's torso and having a fixed length between the safety harness and a lanyard extending to an anchor point, and the person having a leg length between the person's torso and the person's feet, the apparatus comprising:

a support assembly configured for suspension from the lanyard wherein the support assembly has at least one foot support to allow at least one of the person's feet to be placed on said at least one foot support, said support assembly including a fixed length strap and an adjustable length strap, the fixed length strap having one end connected to the lanyard and another end connected to an adjustment member to connect the adjustment member to the lanyard;

said adjustable length strap attached to the adjustment member, said adjustable length strap cooperating with said adjustment member to adjust an adjustable length between the another end of the fixed length strap and said foot support; and said adjustable length strap being movable relative to said adjustment member while being worn by the person in suspension to cause said adjustable length to be less than the fixed length plus the leg length to allow the person to place weight on the foot support to reduce constriction of the safety harness on the person's torso.

15. An apparatus for reducing the effect of suspension trauma to a person suspended by a safety harness from a lanyard, the safety harness being adapted for attachment to a person's torso and having one end attached to the lanyard by a lanyard connection, a harness length between the safety harness and lanyard connection being fixed, comprising:

a first strap having a fixed length with one end connected to an adjustment member and another end configured for attachment at a fixed length to the lanyard connection;

a support assembly having at least one foot support to allow at least one of the person's feet to be placed on said at least one foot support;

being a second strap with one end attached to the adjustment member and another end attached to the support assembly supporting the at least one foot support, said one end of the second strap cooperating with said adjustment member to adjust an adjustable support length between said adjustment member and said foot support; and said second strap being movable relative to said adjustment member while being worn by the person in suspension to cause said adjustable support length to be adjusted while said harness length and said first strap fixed length remain fixed to allow the person to place weight on the foot support to reduce constriction of the safety harness on the person's torso.

* * * * *